US005604559A

United States Patent [19]

Yamanouchi et al.

[11] Patent Number: 5,604,559

[45] Date of Patent: Feb. 18, 1997

[54] PHOTOSENSITIVE MATERIAL PROCESSING APPARATUS

[75] Inventors: Kenji Yamanouchi; Noriyoshi Suzuki, both of Hino, Japan

[73] Assignee: Konica Corporation, Tokyo, Japan

[21] Appl. No.: 503,765

[22] Filed: Jul. 18, 1995

[30] Foreign Application Priority Data

Jul. 28, 1994 [JP] Japan ..... 6-177031

[51] Int. Cl.[6] ..... G03D 3/02

[52] U.S. Cl. ..... 396/578; 396/570; 396/626

[58] Field of Search ..... 354/298, 324; 430/398–400

[56] References Cited

U.S. PATENT DOCUMENTS 5,318,061 7/1994 Saito ..... 354/324
5,351,103 9/1994 Komatsu et al. ..... 354/324
5,400,105 3/1995 Koboshi et al. ..... 354/324

*Primary Examiner*—D. Rutledge
*Attorney, Agent, or Firm*—Finnegan, Henderson, Farabow, Garrett & Dunner, L.L.P.

[57] ABSTRACT

A photosensitive material processing apparatus includes plural processing tanks each to process a photosensitive material; plural cartridges each to fill solid processing agents for replenishment used in each of the plural processing tanks. The apparatus further includes plural replenishing devices each to replenish the solid processing agent in each of the cartridges into each of the processing tanks; a memory to store information indicating the standard quantity and information of an allowable quantity in surplus or shortage against the standard quantity which is a limited quantity allowing replenishment; a residual quantity detector to give an output signal corresponding to the solid processing agent whose residual quantity reaches zero; and a solid processing agent replenishment controller to control the replenishment of solid processing agents in the cartridges other than a cartridge for which the output signal is given, based on the information of the quantity for overs and shorts against standard stored in the memory.

11 Claims, 8 Drawing Sheets

FIG. 6

| | | | | |
|---|---|---|---|---|
| KIT | N1 | × × × × | N2 | × × × × |
| CAPACITY | N3 | × × × × | N4 | × × × × |

× × × × : 4 - DIGIT NUMBER

FIG. 7

KIT RESIDUAL NUMBER CORRECTION

N1 × × × × ± × × N2 × × × × ± × ×

KIT RESIDUAL NUMBER CORRECTION

N3 × × × × ± × × N4 × × × × ± × ×

× × × × : KIT RESIDUAL NUMBER

× × : CORRECTION NUMBER

FIG. 9 (a)

REPLACE KIT
REPLACE ALL CARTRIDGES

FIG. 9 (b)

THROW AWAY TABLETS
REMAINING IN CARTRIDGES INTO
WASTE FLUID

FIG. 9 (c)

PRESS "YES" AFTER COMPLETING
SETTING ALL CARTRIDGES

PHOTOSENSITIVE MATERIAL PROCESSING APPARATUS

BACKGROUND OF THE INVENTION

The present invention relates to an apparatus for processing photosensitive materials wherein solid processing agents for photosensitive materials are replenished by means of a cartridge, and more particularly, to an improvement of a technology of replenishing solid processing agents in the course of processing photosensitive materials.

There have hitherto been known automatic processing apparatuses wherein a series of color development, bleaching, fixing and stabilizing are performed automatically for silver halide photographic photosensitive materials.

In such an automatic processing apparatus, a photosensitive material such as a film or a photographic paper is processed when it is fed successively into processing tanks each containing different processing solution, and each processing solution is deteriorated in terms of processing capability because of its fatigue caused by its work of processing photosensitive materials and because of another processing solution in a preceding tank that is carried to that processing solution as a processing step advances.

For the reasons mentioned above, there have been employed replenishment methods wherein replenisher solutions containing processing agents are replenished periodically based on an area of processed photosensitive materials.

In addition, a publication of WO92/20013 and Japanese Patent Publication Open to Public Inspection No. 119454/1993 (hereinafter referred to as Japanese Patent O.P.I Publication) disclose apparatuses wherein replenishment is made by solidified processing agents (a tablet-shaped processing agent having a circular section prepared by compression-molding powder or granules of processing agent component into a certain shape).

Processing agents for silver halide photographic photosensitive materials include, for example, color developing agents, bleaching agents, fixing agents and stabilizing agents for color negative films, and color developing agents, bleach-fixing agents and stabilizing agents for color photographic papers. In the case of an automatic processing apparatus that is called a minilab and is installed in a photofinishing laboratory, these processing agents in seven kinds need to be replenished to respective processing tanks or those in processing tanks need to be replaced with new agents, resulting naturally in complicated jobs and erroneous operations of putting in wrong tanks.

Owing to solidified processing agents, ease of handling has been attained considerably. For processing color films and color papers, however, management such as purchasing at least seven kinds of processing agents individually in accordance with a necessary quantity of each processing agent has been time-consuming.

SUMMARY OF THE INVENTION

The invention has been attained in view of the problems mentioned above, and its object is to save users trouble sharply with easy work of replacing processing agents.

One of the embodiments of the invention is represented by a photosensitive material processing apparatus provided with a plurality of processing tanks through which photosensitive materials pass while being immersed therein in succession to be processed, cartridges each being filled with solid processing agents of each kind for replenishment used in the aforesaid processing tank and each containing its own standard quantity of the aforesaid solid processing agent so that an amount of the solid processing agents established in advance for processing light-sensitive materials in prescribed quantity shows the residual quantity of zero simultaneously for all processing tanks, and solid processing agent replenishing means each replenishing the solid processing agent in the cartridge into the processing tank, wherein there are provided memory means in which information indicating the aforesaid standard quantity and information of an allowable quantity for overs and shorts against standard which is a limited quantity allowing replenishment are stored, residual quantity detecting means giving output signals corresponding to the aforesaid solid processing agent whose residual quantity reaches zero, and solid processing agent replenishment control means that controls, based on information of the quantity for overs and shorts against standard stored in the aforementioned memory means, the replenishment of solid processing agents in the cartridges other than the cartridge for which the aforesaid output signals are given. The term "overs and shorts against standard" means the overages or surpluses and the shortages or deficits when compared to the standard quantity.

In this case, the aforesaid solid processing agent replenishment control means may be constituted so that it controls, based on information of the quantity for overs and shorts against standard stored in the aforementioned memory means, to replenish solid processing agents in the cartridges other than the cartridge for which the aforesaid output signals are given by an allowable quantity for overs and shorts against standard.

In addition, the aforesaid solid processing agent replenishment control means may also be constituted so that it continuously controls, for the period corresponding to the allowable quantity for overs and shorts against standard of the cartridge for which the aforesaid output signals are given, the replenishment of solid processing agents in the cartridges other than the aforementioned cartridge.

Furthermore, there may be provided in the constitution a replacement-requesting means that requests replacement of cartridges for all processing tanks after completion of replenishment control conducted by the aforesaid solid processing agent replenishment control means.

Or, there may be provided in the constitution a residual quantity correcting means that corrects the residual quantity based on the input of change in residual quantity of the solid processing agents.

Further, the solid processing agents may also be tablet-shaped solid processing agents.

In the photosensitive processing apparatus having the aforementioned constitution, when the residual quantity detecting means detects that the residual quantity of solid processing agents in any of the cartridges each having a standard quantity reaches zero, the solid processing agent replenishment control means controls replenishment of solid processing agents in the cartridges other than the aforementioned cartridge based on information of an allowable quantity for overs and shorts against standard stored in the aforementioned memory means. Therefore, there is performed replenishment control that makes it possible to replace a kit for the succeeding cycle smoothly while keeping the state of each processing solution stable, thus it is possible to save users trouble sharply with easy work of replacing processing agents.

In the constitution where the solid processing agent replenishment control means mentioned above controls to replenish, by the allowable quantity for overs and shorts against standard, the solid processing agents in all cartridges other than one for which the aforesaid output signals are given based on information of allowable quantity for overs and shorts against standard stored in the memory means, or the aforesaid solid processing agent replenishment control means controls continuously, for the period corresponding to the allowable quantity for overs and shorts against standard of the cartridge for which the aforementioned output signals are given, the replenishment of solid processing agents in the cartridges other than the aforesaid cartridge, when the residual quantity in any one of plural cartridges reaches zero, processing agents within an allowable range determined for each processing agent are replenished before an end. Accordingly, it is possible to replace a kit for the succeeding cycle smoothly without wasting solid processing agents.

In the constitution where there is provided a replacement-requesting means which requests replacement of all solid processing agents after completion of replenishment control performed by the solid processing agent replenishment control means, it is possible to know the timing of kit replacement easily because replacement of each kit is indicated.

In the case of constitution where a residual quantity correcting means that corrects the residual quantity based on the input of change in residual quantity of the solid processing agents, the input of change in the occasion where the aforesaid solid processing agents are lost or damaged corrects the residual quantity, making it possible to grasp accurately the residual quantity.

Further, by making the aforesaid solid processing agents to be tablet-shaped, it is possible to reduce replenishment quantity compared with conventional solution and thereby to miniaturize a replenishing cartridge, which attains ease of handling and prevents that solution scatters on the human body, clothes and surrounding equipment to stain them during operation.

BRIEF DESCRIPTION OF THE DRAWINGS

FIG. 6 is a diagram showing a display portion in the course of inputting in the example.

FIG. 7 is a diagram showing a display portion in the course of correction processing for residual number of kits in the example.

FIGS. 9(*a*)–9(*c*) are diagrams showing displays for kit replacement in the example.

DETAILED DESCRIPTION OF THE PREFERRED EMBODIMENT

Examples of the invention will be explained as follows.

Though tablet-shaped solid processing agents are used in the processing apparatus in the following example which will be explained below, the solid processing agents are not limited to the tablet-shaped one but are free to be granules and others. By making the aforesaid solid processing agents to be tablet-shaped, it is possible to obtain peculiar effects to reduce replenishment quantity compared with conventional solution and thereby to miniaturize a replenishing cartridge, which attains ease of handling and prevents that solution scatters on the human body, clothes and surrounding equipment to stain them during operation, Further, though the automatic processing apparatus in the example is equipped with four processing tanks, any photosensitive processing apparatus having plural processing tanks can be included in the invention.

Figure 1:
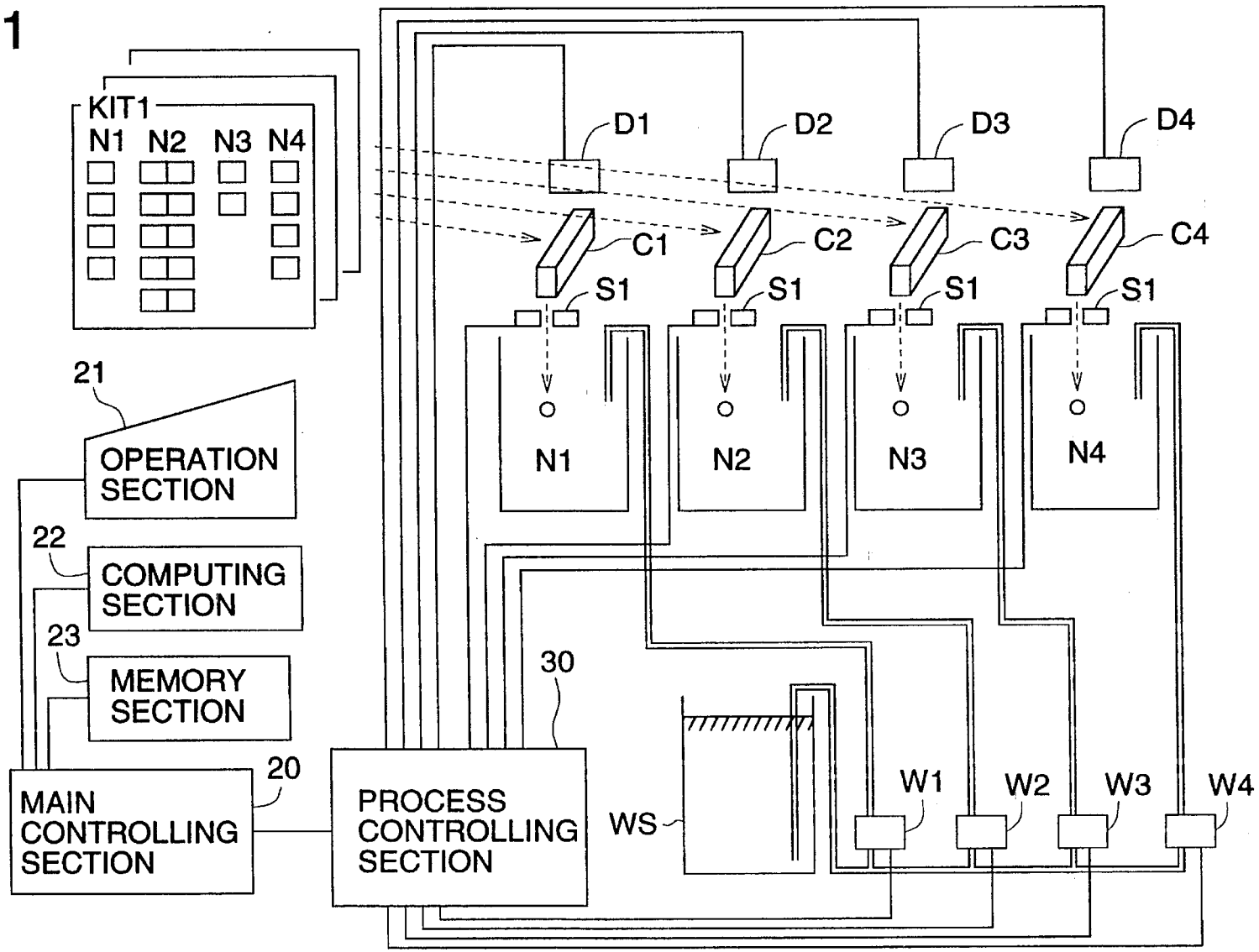
FIG. 1 is a schematic structural diagram of an automatic processing apparatus in an example of the invention.
Figure 2:
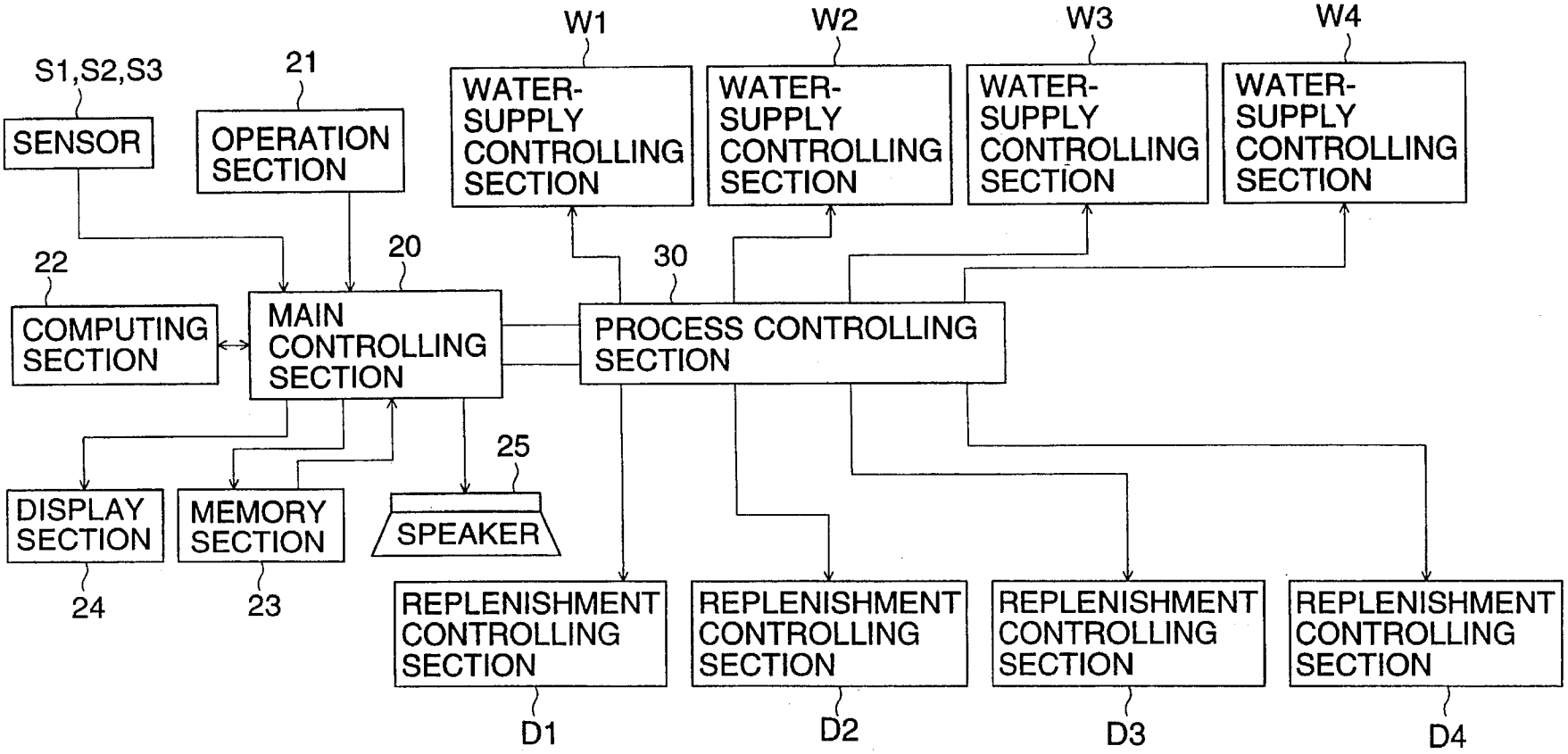
FIG. 2 is a block diagram in brief showing replenishment control for the automatic processing apparatus in the example.

FIG. 1 shows the structure in brief of an automatic processing apparatus in the present example, while FIG. 2 is a block diagram in brief showing replenishment control for the automatic processing apparatus.

In FIG. 1, the automatic processing apparatus is provided with four processing tanks of tank N1, tank N2, tank N3 and tank N4 which perform respectively color developing process, bleaching process, fixation process and stabilization process. To each processing tank, a long photosensitive material is transported and then immersed therein to be processed in succession. Photosensitive materials to be processed in this case mean all materials having photosensitive properties such as photographic color (and black and white) negative (and positive) films and photographic papers.

Each of these processing tanks is provided with solid processing agent dispenser 10 (shown in FIG. 3) so that cartridges C (C1, C2, C3 and C4) containing tablet-shaped solid processing agents may be attached thereto. Since all of these cartridges C in the present example are cylindrical container having the same dimensions and shape, the production cost of the cartridge C can be reduced. In addition, on the surface of the cartridge C, there are provided information including kinds of tablets and others which enable one to discriminate the kind of a tablet when they are read. Furthermore, the cartridge C is provided with a projection for discriminating a kind of a tablet which prevents tablets from being loaded in wrong solid processing agent dispenser 10.

A shape of a tablet-shaped solid processing agent (hereinafter referred to as tablet J) can be any of shapes of a disk, a sphere, a column or the like provided that the tablet has a volume which is almost constant.

Figure 3:
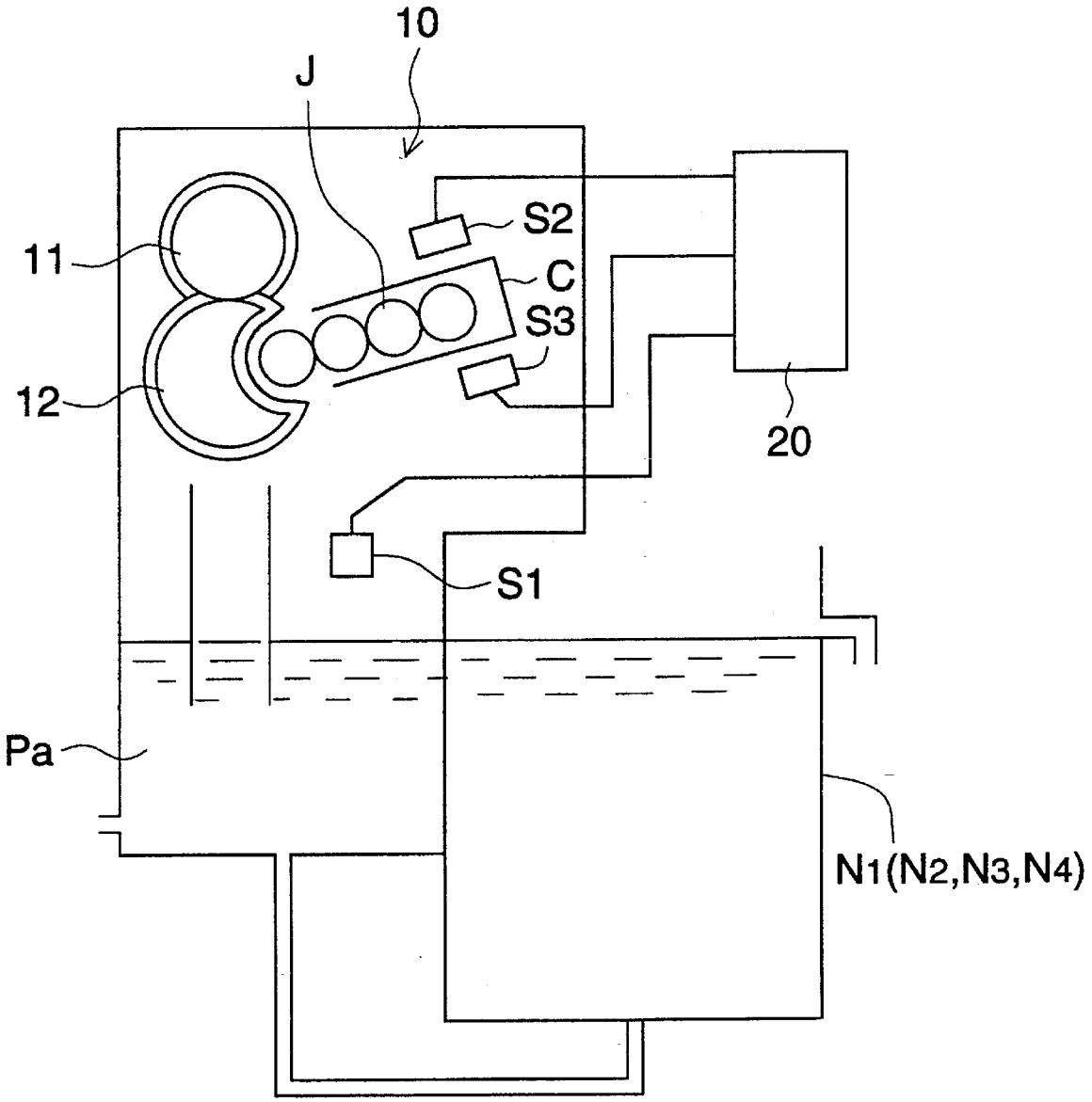
FIG. 3 is a structural diagram in brief of a solid processing agent dispenser in the example.

In FIG. 3 showing a schematic constitutional diagram of the solid processing agent dispenser 10, cartridge C is loaded, after being opened, in the solid processing agent dispenser 10 in a way that tablet J in the cartridge can fall through the opening of the cartridge. In the vicinity of the solid processing agent dispenser 10, there are provided sensors S1, S2 and S3. The sensor S1 is a tablet-detecting sensor which detects the number of tablets J to be dispensed and the sensor S2 is a sensor that detects whether the cartridge C is loaded in the solid processing agent dispenser 10 or not. The sensor S3 is a sensor that detects a type of cartridge C (kit number and lot number) and detects a kind of tablet J.

After the cartridge C is loaded in the solid processing agent dispenser 10, driving portion 11 is driven to rotate conveyance drum 12. The conveyance drum 12 takes tablet J out of the cartridge C while making one turn, or it causes tablet J to fall by gravity and receives it so that the tablet J may be dispensed in replenisher tank Pa in accordance with the control of main control unit 20.

In FIG. 2, the main control unit 20 controls total operations of an automatic processing apparatus. Operation section 21 is an input device including a key board and switches, computing section 22 is a computing device such as replenishment timing, memory section 23 is a memory device for parameters related to replenishment control and display section 24 wherein liquid crystals are used indicates a request of cartridge replacement or kit replacement. Further, process controlling section 30 is a control section that controls processing, and each of replenishment controlling sections D1, D2, D3 and D4 controls operations to replace tablet J, and each of water-supply controlling sections W1, W2, W3 and W4 controls operations to supply water. Speaker 25 is used for requesting kit replacement and others through a voice or a buzzer.

In the replenishment control system of the invention, the number of tablets per kit for each processing tank and others are stored in memory section 23. The number of dispensed tablets detected by sensor S1 is computed by computing section 22, thus the residual number of tablets per kit is calculated. A quantity of tablets J failed accidentally to be dispensed in a processing tank (related to the correction quantity for residual number) and others are inputted from operation section 21. These quantities may also be detected by a detecting means provided separately, as a matter of course. With regard to water-supply from water-supply tank WS to each processing tank, an amount of water-supply to each processing tank per kit is stored and computed similarly.

Next, replenishment control for tablet J by means of the solid processing agent dispenser 10 will be explained as follows.

Figure 4:
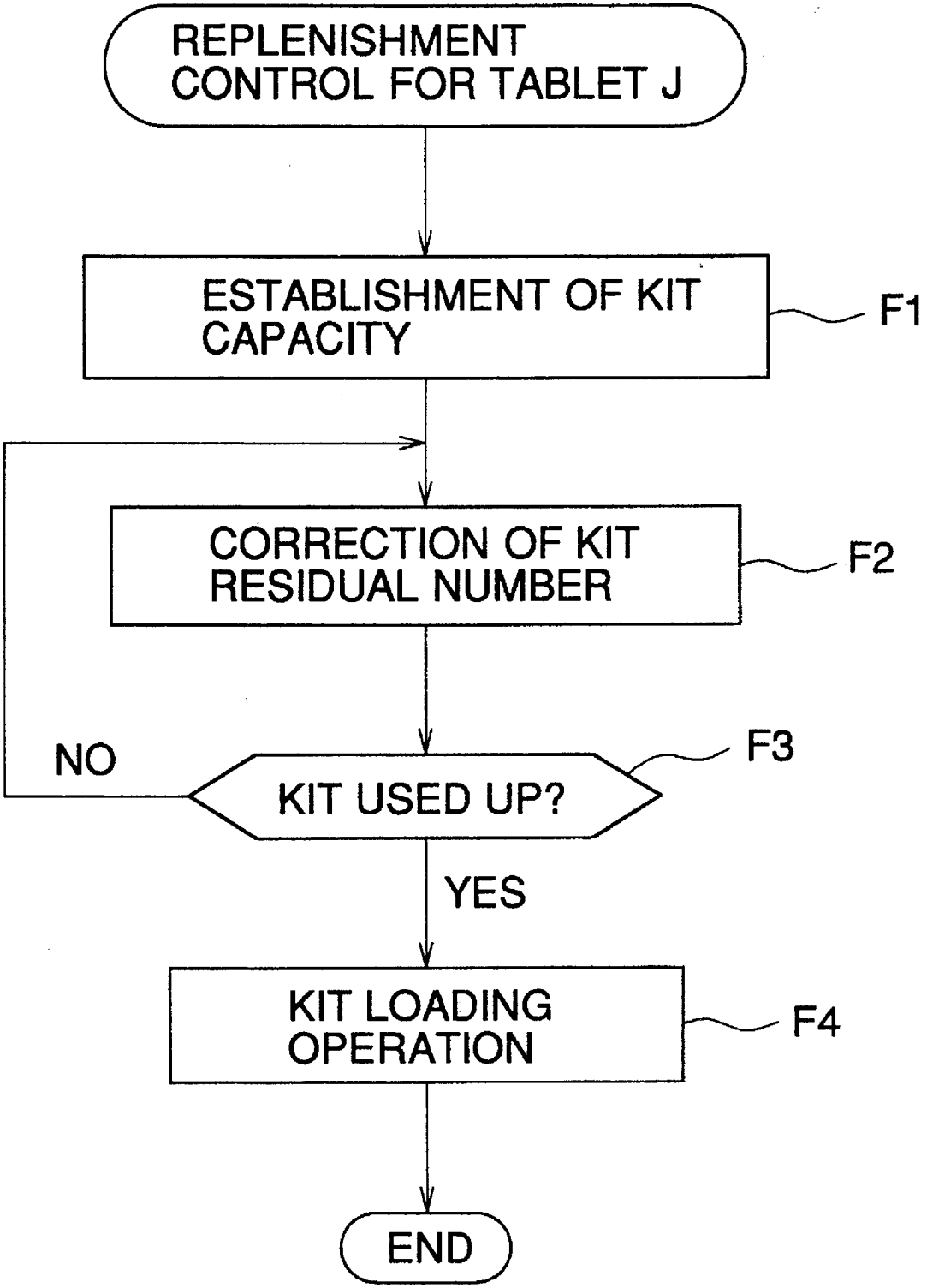
FIG. 4 is a flow chart of main processing in the example.

FIG. 4 shows a flow chart for main processing of tablet J, and in F1, when a user establishes the number of each tablet J per kit through operation section 21, main controlling section 20 causes the information of that number to be stored in memory section 23 as stated above, and the basic replenishment quantity of each solid processing agent stated later is calculated.

In F2, when tablet J is reduced in terms of number without being used due to abnormal reasons such as damage or loss of tablets caused by unexpected accident in the course of processing photosensitive materials, the residual number of tablet J of each solid processing agent per kit which is stored in memory section 23 is corrected by main controlling unit 20 if a user inputs a change of the reduced number from operation section 21.

Then, when the residual number of tablets J in a kit reaches zero, the replenishment processing for a kit is performed on an automatic processing apparatus in F3. In F4, the replacement control that varies depending on whether the cartridge C whose residual number of tablet J reaches zero belongs to N1 tank or to N2–N4 tanks is performed based on information of the allowable quantity for overs and shorts against standard of memory section 23.

The allowable quantity for overs and shorts against standard will be explained here. Power (concentration or the like) of each processing solution has its own allowable range, and as long as this range is kept, overs and shorts in dispensing tablet J do not affect processing capability of the processing solution, and the quantity of tablet J in this range is defined as an allowable quantity for overs and shorts against standard.

Next, Table 1 shows an example of specifications for cartridges and tablets J per kit of solid processing agents to be dispersed in processing tanks N1, N2, N3 and N4 in the present example, and in the example, one kit is composed of one box.

TABLE 1

| | Processing tanks | | | |
|---|---|---|---|---|
| Specification items | N1 | N2 | N3 | N4 |
| J cartridge specifications | 2 rows × 10 tablets | 4 rows × 10 tablets | 4 rows × 10 tablets | 1 row × 10 tablets |
| J package specifications (cartridge/box) | 7 | 5 | 19 | 1 |
| J dispensing specifications (tablet/times) | 1 | 2 | 2 | 1 |
| Kit unit (tablets) | 140 | 200 | 760 | 10 |
| Allowable quantity for overs and shorts against standard | 3 | 12 | 14 | 1 |

Each row in each cartridge has a capacity for 10 tablets J, and all tablets are filled closely leaving no space between them before the start of using them. Therefore, it is prevented that tablets J are damaged or worn out by vibration of transport in the course of distribution. Namely, the aforementioned effects can be attained when tablets J are manufactured to satisfy the conditions that tablets J in a certain quantity can be filled closely in cartridge C leaving no space between them and to keep the concentration of processing solution.

Figure 5:
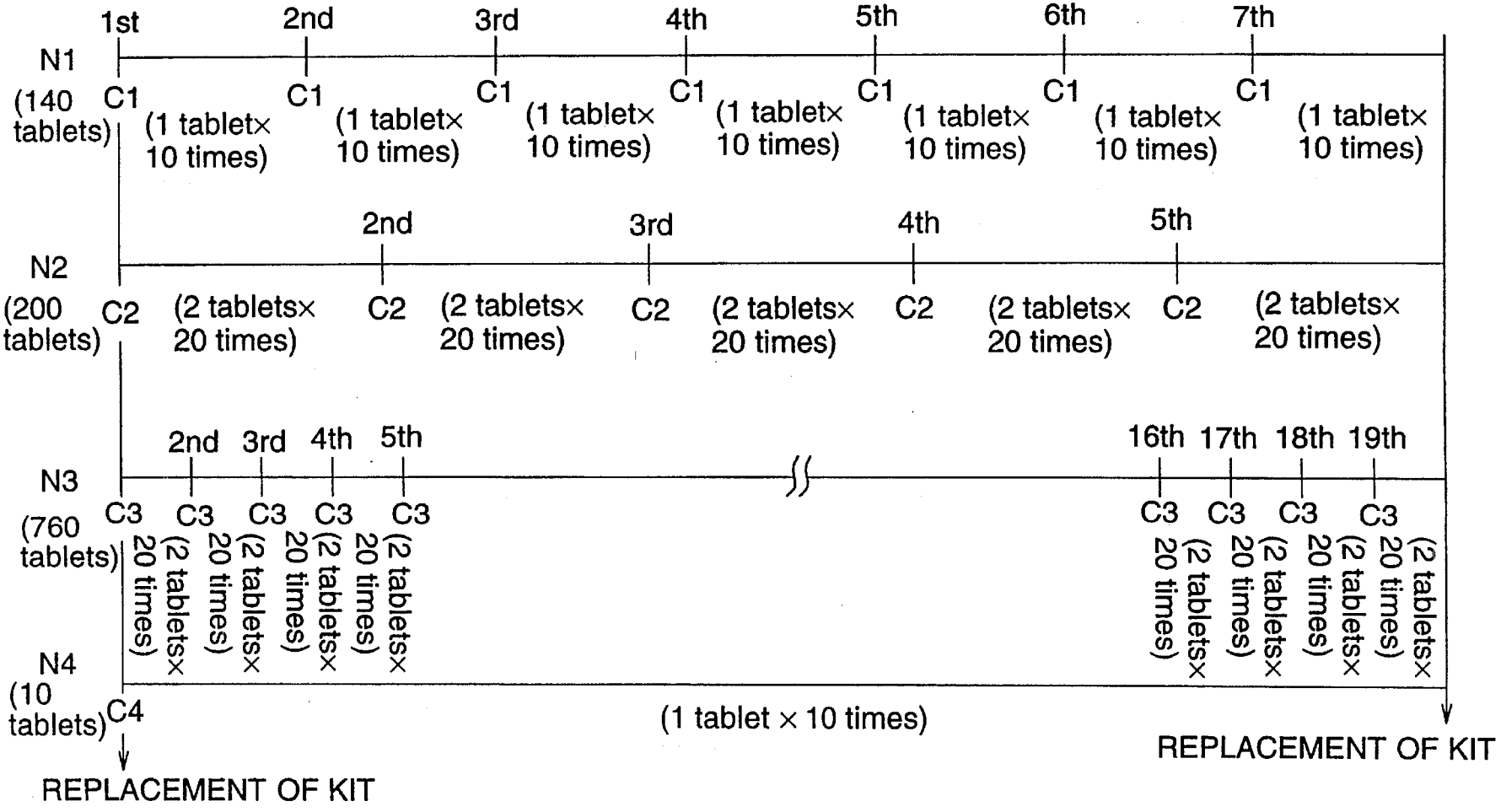
FIG. 5 is a diagram showing replacement of cartridges and kits in one cycle in the example.

Cartridge replacement and kit replacement in one cycle are shown in FIG. 5 showing the standard state wherein cartridges C1, C2, C3 and C4 corresponding respectively to solid processing agent dispensers 10 provided on processing tanks N1, N2, N3 and N4 are loaded and tablets J are dispensed, and the axis of abscissas represents the volume of processed photosensitive materials.

Namely, in replenishment control for ordinary solid processing agents, quantity of solid processing agents in each kind is controlled so that solid processing agents in all containers may be used up simultaneously and a kit may be replaced on the occasion of kit replacement, namely so that one cycle may be covered by one kit, as shown in FIG. 5, A kit is naturally constituted so that tablets J in all cartridges C are used up simultaneously in the case of kit replacement. However, the invention is characterized by control of dispensing tablet J conducted after the occasion wherein clogging of processing agents, damage or loss of processing agents caused by unexpected accident takes place on the half way of replenishment of solid processing agents, then the quantity of processing agents in a kit stored is changed, and thereby all processing agents are not used up simultaneously and residual quantity of tablets J in cartridge C reaches zero.

First, in the establishment of kit capacity, the quantities of tablets J in various types (140 tablets, 200 tablets, 760 tablets and 10 tablets) to be dispensed into respective processing tanks N1, N2, N3 and N4 are inputted newly in memory section 23 as a standard quantity, each time the kit is replaced. As a display during inputting, N1 through N4 are indicated for each item to be inputted as shown in FIG. 6 wherein display portions 24 are indicated, so that a user can input values by the use of a ten-key array. Each number of cartridges to be replaced (7 cartridges, 5 cartridges, 19 cartridges and 1 cartridge) in a kit is also inputted in the memory section 23. Further, each allowable quantity for overs and shorts against standard (3 tablets, 12 tablets, 14 tablets and 1 tablet) which will be described later is also inputted in the memory section 23. In this case, the memory section 23 is composed of a volatile memory such as a RAM, and usually, establishment can be done by reading out the quantity of tablets J in each type registered as a standard value in advance on the memory section 23. However, input setting is conducted so that it is possible to cope with a change of a fixed quantity for processing. Though the inputting is conducted manually, it is also possible to input automatically through detection of types of processing agents and kits made by sensor S3. Further, a replenishment quantity determined depending on the type of a processing agent for solid processing agents in the case of processing a predetermined photosensitive material, namely the quantity of tablets to be dispensed simultaneously (1 tablet, 2 tablets, 2 tablets and 1 tablet) and the quantity of tablets necessary for a unit length of a photosensitive material for N1 are inputted similarly in the memory section 23, thus the photosensitive material is processed in accordance with a processing program inputted in the aforementioned ROM. This quantity of tablets needed for processing a unit length determines timing for dispensing each tablet J as described later.

When a series of inputting operations are completed, computing section 22 calculates, in accordance with a processing program, the quantity of tablets J needed for processing a unit length which is different for each type of tablet. The expression for calculation is represented by the following.

$$A_n = A_1 \times \frac{\text{Kit capacity of } N_n}{\text{Kit capacity of } N1}$$

$A_1$: Quantity of N1 tablet J needed for a unit length of photosensitive material (tablets/$m_{(135)}$)

$A_n$: Quantity of another tablet J needed for a unit length of photosensitive material (tablets/$m_{(135)}$)

$A_1$ is 0.1179 (tablets/$m_{(135)}$), and this means that 0.1179 tablets need to be dispensed for processing one meter of 135 mm film. Namely, it is controlled that $A_1$ is accumulated while counting the length of processed photosensitive materials so that processing agents are dispensed when the accumulated value reaches the quantity of tablets to be dispensed simultaneously. With regard also to tablets J for N2–N4, the expression above is used for calculation based on $A_1$, and calculated results are inputted in the memory section 23. In the calculation, a fraction is manipulated in a way to produce an excessive quantity of tablets J for N2–N4. Therefore, it does not happen that the number of tablets J for N2–N4 is insufficient for that of tablets J for N1.

Further, for the quantity of tablets J necessary for the processing of a unit length, there is prescribed a range which allows the establishment ranging from 250% to 20%.

After processing is started, sensor S1 calculates a quantity of tablets J dispensed each time tablets J are dispensed, and computing section 22 calculates a residual quantity of tablets J in each cartridge C based upon input data read out of memory section 23. In ordinary processing, a quantity of tablets J obtained by subtracting a quantity of tablets J used actually for processing from a quantity of tablets J in each kit for each processing tank necessary for processing a predetermined amount of photosensitive materials agrees with a quantity of tablets J remaining unused in the kit. Therefore, at the moment of completion of processing for a certain amount of photosensitive materials, kits are replaced under the condition that no tablet J remains unused for any processing tank. A prediction for kit replacement is indicated on display section 24 when a residual quantity of tablets for each processing tank comes to the prescribed value or less immediately before the kit is finished, and a request for kit replacement is displayed when the residual quantity of tablets comes to zero. The kit replacement is sometimes requested through a voice or lighting of a request lamp, instead of the display. Since the kit replacement is predicted as in the foregoing, a user can replace cartridges smoothly. In processing, when the residual quantity of tablets J is varied by damage or loss of tablets which is caused, on the half way of replenishment of solid processing agent, by clogging of processing agents or unexpected accident, the residual quantity of tablets in the kit is corrected. In that correction, a display shown in FIG. 7 is displayed on the display section 24 when a prescribed operation is made on the operation section 21. Therefore, a user can correct the residual quantity by inputting the quantity for residual quantity correction by the use of a ten-key array. Since the correction of residual quantity in a kit can be made at any time in the course of processing, it is possible to cope with a change in residual quantity of tablets J quickly. The maximum value of the correction quantity is a value obtained by subtracting 1 from the standard quantity for cartridge C. The reason for this is to replace cartridge C when the correction quantity comes to be equal to the standard quantity for cartridge C. Since computing section 22 corrects the residual quantity of tablets J in the memory section based on the correction value that is set and inputted, a correct residual quantity can be grasped.

A photosensitive material processing apparatus of the present example is provided with sensor S1 that detects a quantity of solid processing agents replenished to each processing tank and an undispensed quantity detecting means (not shown) that detects the quantity of solid processing agents before being dispensed. Based on the quantity of solid processing agents per kit stored in memory section 23, a replenishment quantity of solid processing agents outputted from sensor S1 and the undispensed quantity outputted from the undispensed quantity detecting means, the residual quantity for each processing tank can be detected. When solid processing agents of a particular type to be replenished to a particular processing tank are used up earlier than others for some reason such as, for example, an apparatus trouble or the like, other solid processing agents for other processing tanks still remain unused. These remaining solid processing agents are called excess solid processing agents.

Figure 8:
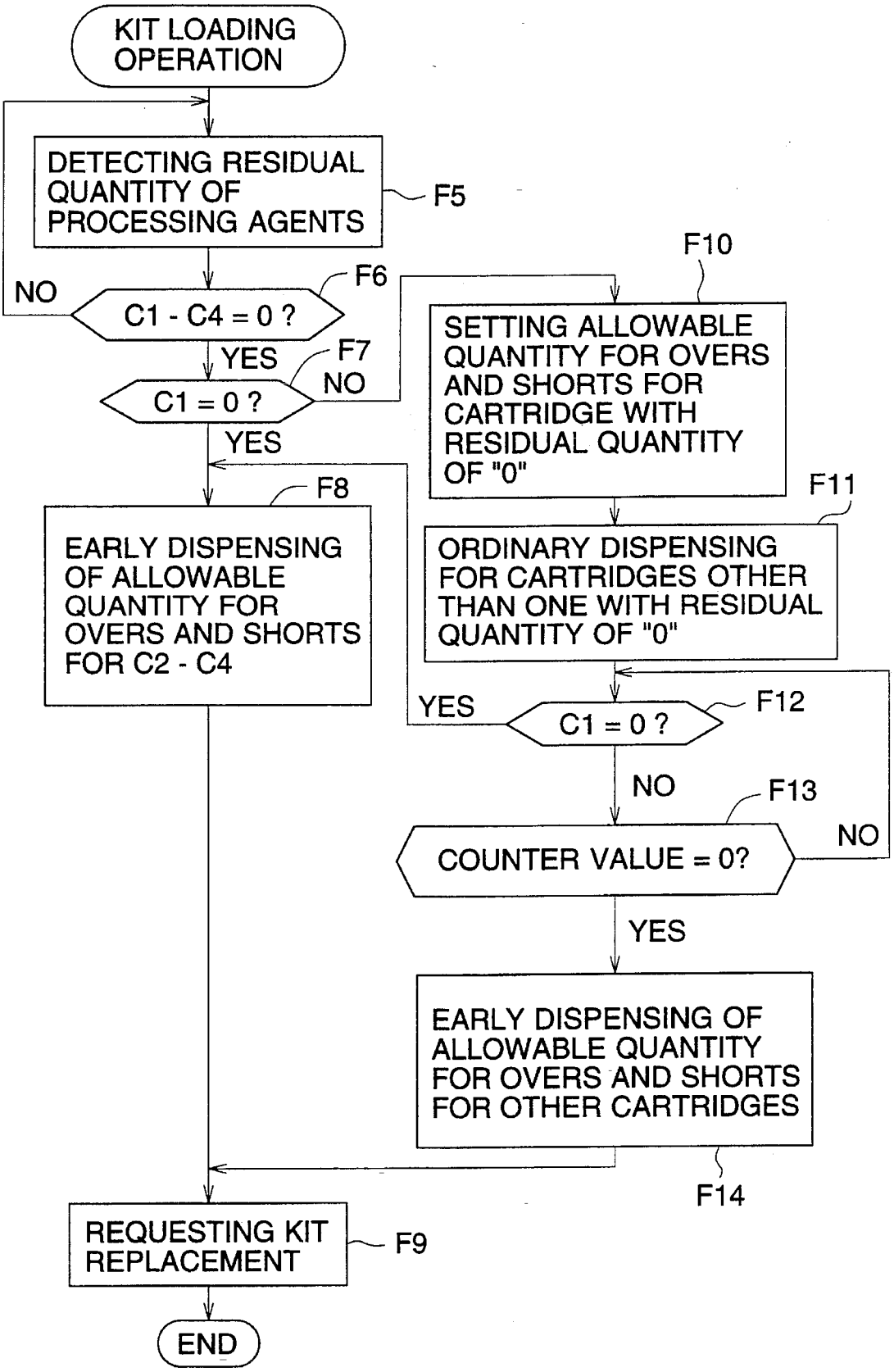
FIG. 8 is a flow chart of kit supply processing in the example.

In a photosensitive material processing apparatus of the invention, a residual quantity of processing agents is constantly or periodically detected in the course of processing of photosensitive materials, and a residual quantity of each solid processing agents per kit is monitored by main control section 20. FIG. 8 represents a flow chart of kit loading operation.

In the steps of F5–F7, when tablet J in some cartridge C is used up while being monitored, the main control section 20 discriminates whether that cartridge is C1 or C2–C4, and performs loading operation which varies depending on the type of the cartridge. The reason for the above is that the control of concentration in color developing is most important in photographing processing and it therefore is necessary to distinguish processing agents for the color developing from other processing agents. When tablets J in cartridge C1 are considered to be used up earlier than others, tablets in an allowable quantity for overs and shorts against standard for each of cartridges C2–C4 are dispensed earlier in the step F8. The allowable quantity for overs and shorts against standard will be explained hereon again. Power (concentration or the like) of each processing solution has its own allowable range, and as long as this range is kept, overs and shorts in dispensing of tablet J do not affect the processing capability of the processing solution, and a quantity of tablets J corresponding to the aforesaid overs and shorts is defined to be an allowable quantity for overs and shorts against standard.

Namely, in a conventional way, a kit should be replaced when tablets J in a certain cartridge in that kit are used up first. In the invention, however, tablets J corresponding to the allowable quantity for overs and shorts against standard among excess solid processing agents in other cartridges C are dispensed, through the observation of the allowable quantity for overs and shorts against standard, so that kits may be replaced for the succeeding cycle smoothly without wasting solid processing agents. In the step F9, a request of kit replacement is displayed on display section 24 because a user is informed when the dispensation of the allowable quantity for overs and shorts against standard in C2–C4 is finished.

On the other hand, when cartridge C other than cartridge C1 is judged to be empty in step F7, the allowable quantity for overs and shorts against standard for the finished cartridge is set on a counter in a replenishment controlling section, in step F10. Then, based on the quantity of tablets necessary for processing a unit length of a photosensitive material, the allowable quantity for overs and shorts against standard set on the aforementioned counter is reduced gradually, and until the end of a period required for the value on the counter to come to zero, tablets J of each type keep being dispensed from other cartridges in a normal way (F11). In steps F13 and F14, processing is completed at the moment when the value in the counter comes to zero, and tablets in an allowable quantity for overs and shorts against standard are dispensed earlier from other cartridges containing excess solid processing agents, thus, in step F9, kit replacement is requested. Therefore, even if nothing is dispensed for the prescribed period corresponding to an allowable quantity for overs and shorts against standard after cartridge C other than cartridge C1 is emptied, the processing capability can be maintained, and it is possible to save waste by keeping dispensing other processing agents.

When tablets J in cartridge C1 are used up (in step F12) during the aforementioned prescribed period, tablets corresponding in quantity to the allowable quantity for overs and shorts against standard for other cartridge C containing excess solid processing agents are dispensed earlier as in the case where cartridge C1 is emptied first, and then, kit replacement is requested.

Water-supply controlling sections W1–W4 shown in FIG. 2 can control an amount of water-supply depending on "early dispensing of allowable quantity for overs and shorts for other cartridges (step F8 and F14)" or on "ordinary dispensing for other cartridges (step F11)" for the aforementioned solid processing agents.

Next, kit replacement will be explained. FIGS. 9(*a*)–(*c*) show display sections 24 for kit replacement. In the aforesaid step F9, a display as shown in FIG. 9(*a*) is indicated, and a buzzer sounds through speaker 25 as soon as a lamp (not shown) showing the readiness for kit replacement is put out. Then, when a user removes cartridges C1–C4 and presses button YES on operation section 21, a display shown in FIG. 9(*b*) appears and how to do with excess solid processing agents is indicated. Therefore, a user is not puzzled with how to do with excess solid processing agents. At this moment, the buzzer stops sounding.

When the button YES is pressed again, there is given an indication for the starting which is for an automatic processing apparatus to be in the state of reset, and when the button YES is pressed again, input information of memory section 23 is reset to return to the initial state for setting the following kit. As stated above, it is easy to know the timing for kit replacement because of indication for replacement in a kit unit, and it is possible to replace kits easily because of the man-machine interface employed that displays at any time, based on user's instructions, a message that tells user's operations for kit replacement.

As explained above, in the photosensitive material processing apparatus of the invention, when a residual quantity detecting means detects that residual quantity of solid processing agent in some cartridge of standard quantity comes to zero, a solid processing agent replenishment control means controls replenishment of solid processing agents in other cartridges based on information of the allowable quantity for overs and shorts against standard of the aforesaid memory means. Therefore, it is possible to save labor of a user remarkably by causing him conduct replacement work easily through the replenishment control that makes it possible to replace a kit for the following cycle smoothly, while keeping the state of each processing solution stable.

In the case where the aforesaid solid processing agent replenishment control means controls to replenish, by the quantity corresponding to the allowable quantity for overs and shorts against standard, solid processing agents in all other cartridges excluding the cartridge about which the aforesaid output signals have been given, based on information of the allowable quantity for overs and shorts against standard of the aforesaid memory means, and the aforesaid solid processing agent replenishment control means keeps controlling replenishment of solid processing agents in other cartridges for the period corresponding to the allowable quantity for overs and shorts against standard of the cartridge about which the aforesaid output signals have been given, when residual quantity in either one of plural cartridges comes to zero, other cartridges are finished after processing agents therein which are within an allowable range established for each processing agent are replenished. Therefore, it is possible to replace a kit for the succeeding cycle smoothly without wasting solid processing agents.

In the case where there is provided a replacement requesting means that requests replacement of all solid processing agents after the completion of replenishment control made by the aforesaid solid processing agent replenishment control means, replacement in a kit unit is indicated. Therefore, it is possible to know the timing of kit replacement easily.

Further, in the case where there is provided a residual quantity correcting means that corrects the residual quantity based on input of change in residual quantity of the aforesaid solid processing agents, the residual quantity is corrected by input of change in the case of loss or damage of the aforesaid solid processing agents, thus, accurate residual quantity can be grasped.

Further, by making the aforesaid solid processing agents to be tablet-shaped, it is possible to reduce replenishment quantity compared with conventional solution and thereby to miniaturize a replenishing cartridge, which attains ease of handling and prevents that solution scatters on the human body, clothes and surrounding equipment to stain them during operation.

What is claimed is:

1. A photosensitive material processing apparatus, comprising:

(a) a first processing tank for processing a photosensitive material;

(b) a second processing tank for processing said photosensitive material;

(c) a first cartridge for storing a plurality of first solid processing agent;

(d) a second cartridge for storing a plurality of second solid processing agent;

(e) first replenishing means for replenishing said first solid processing agent in said first cartridge into said first processing tank;

(f) second replenishing means for replenishing said second solid processing agent in said second cartridge into said second processing tank;

(g) first detecting means for detecting a residual quantity of said first solid processing agent in said first cartridge, wherein said first detecting means outputs a first signal when said residual quantity reaches a first preset value;

(h) second detecting means for detecting a residual quantity of said second solid processing agent in said second cartridge, wherein said second detecting means outputs a second signal when said residual quantity reaches a second preset value;

(i) memory means for storing a first data for replenishment and a second data for replenishment; and (j) controlling means for controlling said first and second processing tank so as to finish processing said photosensitive material in response to said first or second signals, and for controlling said first replenishing means so as to replenish said first processing agent in accordance with said first data for replenishment if said second detecting means outputs said second signal, and for controlling said second replenishing means so as to replenish said second processing agent in accordance with said second data for replenishment if said first detecting means outputs said first signal.

2. The apparatus of claim 1, wherein said first and second preset values are zero.

3. The apparatus of claim 1, further comprising:

a first replenishment detecting means for detecting a replenishment of said first processing agent and outputting a first detecting signal;

a second replenishment detecting means for detecting a replenishment of said first processing agent and outputting a second detecting signal;

wherein said memory means further stores a first solid processing agent quantity data which represents a quantity of solid processing agent filled in said first cartridge and a second solid processing agent quantity data which represents a quantity of solid processing agent filled in said second cartridge;

wherein said first detecting means detects said residual quantity of said first solid processing agent by calculating from said first solid processing agent quantity data and said first detecting signal; and wherein said second detecting means detects said residual quantity of said second solid processing agent by calculating from said second solid processing agent quantity data and said second detecting signal.

4. The apparatus of claim 1, further comprising corrected information input means for inputting information for correcting said residual quantity of said first or second processing agent.

5. The apparatus of claim 1, wherein said controlling means control said first and second replenishing means in accordance with the quantity of photosensitive material processed.

6. A photosensitive material processing apparatus, comprising:

(a) a first processing tank for processing a photosensitive material;

(b) a second processing tank for processing said photosensitive material;

(c) a first cartridge for storing a plurality of first solid processing agent;

(d) a second cartridge for storing a plurality of second solid processing agent;

(e) first replenishing means for replenishing said first solid processing agent in said first cartridge into said first processing tank;

(f) second replenishing means for replenishing said second solid processing agent in said second cartridge into said second processing tank;

(g) first detecting means for detecting a residual quantity of said first solid processing agent in said first cartridge, wherein said first detecting means outputs a first signal when said residual quantity reaches a first preset value;

(h) second detecting means for detecting a residual quantity of said second solid processing agent in said second cartridge, wherein said second detecting means outputs a second signal when said residual quantity reaches a second preset value;

(i) memory means for storing a first data for unreplenishment and a second data for unreplenishment; and (j) controlling means for controlling said first processing tank so as to continue processing said photosensitive material in accordance with said first data for unreplenishment if said first detecting means outputs said first signal, and for controlling said second processing tank so as to continue processing said photosensitive material in accordance with said second data for unreplenishment if said second detecting means outputs said second signal.

7. The apparatus of claim 6, wherein said memory means further stores a first data for replenishment and a second data for replenishment, said controlling means controls:

said second replenishing means so as to replenish said second processing agent in accordance with said second data for replenishment when said first detecting means output said first signal; and said first replenishing means so as to replenish said first processing agent in accordance with said first data for replenishment if second detecting means output said second signal.

8. The apparatus of claim 6, wherein said first and second preset values are zero.

9. The apparatus of claim 6, further comprising a first replenishment detecting means for detecting a replenishment of said first processing agent and outputting a first detecting signal;

a second replenishment detecting means for detecting a replenishment of said first processing agent and outputting a second detecting signal;

wherein said memory means further stores a first solid processing agent quantity data which represents a quantity of solid processing agent filled in said first cartridge, and a second solid processing agent quantity data which represents a quantity of solid processing agent filled in said second cartridge;

said first detecting means detects said residual quantity of said first solid processing agent by calculating from said first solid processing agent quantity data and said first detecting signal; and said second detecting means detects said residual quantity of said second solid processing agent by calculating from said second solid processing agent quantity data and said second detecting signal.

10. The apparatus of claim 6, further comprising corrected information input means for inputting information for correcting said residual quantity of said first or second processing agent.

11. The apparatus of claim 6, wherein said controlling means control said first and second replenishing means in accordance with the quantity of photosensitive material processed.

* * * * *